United States Patent [19]

Ohe et al.

[11] Patent Number: 4,819,001

[45] Date of Patent: Apr. 4, 1989

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 801,310

[22] Filed: Nov. 25, 1985

[30] Foreign Application Priority Data

| | | | |
|---|---|---|---|
| Nov. 26, 1984 | [JP] | Japan | 59-250344 |
| Nov. 26, 1984 | [JP] | Japan | 59-250345 |
| Dec. 6, 1984 | [JP] | Japan | 59-258806 |

[51] Int. Cl.[4] ..... H01Q 1/32

[52] U.S. Cl. ..... 345/712; 343/713

[58] Field of Search ..... 343/711, 712, 713, 741, 343/842, 866, 872

[56] References Cited

U.S. PATENT DOCUMENTS

| | | | |
|---|---|---|---|
| 2,200,674 | 5/1940 | McDoald, Jr. | 343/700 |
| 2,481,978 | 9/1949 | Clough | 343/712 |
| 2,520,986 | 9/1950 | Williams et al. | 343/712 |
| 2,575,471 | 11/1951 | Schweiss et al. | 250/33 |
| 2,740,113 | 3/1956 | Hemphill | 343/787 |
| 2,774,811 | 12/1956 | Shanok et al. | 174/110 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/842 |
| 3,611,388 | 10/1972 | Okumura | 343/712 |
| 3,717,876 | 2/1973 | Volkers et al. | 343/712 |
| 3,728,732 | 4/1973 | Igarashi | 343/712 |
| 3,794,997 | 2/1974 | Iwatsuki | 343/712 |
| 3,823,403 | 7/1974 | Walter et al. | 343/708 |
| 3,916,413 | 10/1975 | Davis | 343/712 |
| 3,961,292 | 6/1976 | Davis | 333/32 |
| 3,961,330 | 6/1976 | Davis | 343/712 |
| 3,972,048 | 7/1976 | Davis | 343/712 |
| 4,003,056 | 6/1977 | Davis | 343/712 |
| 4,080,603 | 3/1978 | Moody | 343/712 |
| 4,217,591 | 8/1980 | Czerwinski | 343/713 |
| 4,278,980 | 7/1982 | Ogita et al. | 343/748 |
| 4,317,121 | 2/1982 | Allen, Jr. et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/842 |
| 4,566,133 | 1/1986 | Rambo | 455/277 |
| 4,633,519 | 12/1986 | Gotoh et al. | 455/277 |

FOREIGN PATENT DOCUMENTS

| | | | |
|---|---|---|---|
| 889618 | 7/1949 | Fed. Rep. of Germany . | |
| 1949828 | 10/1969 | Fed. Rep. of Germany . | |
| 2425189 | 5/1974 | Fed. Rep. of Germany . | |
| 2733478 | 7/1977 | Fed. Rep. of Germany . | |
| 2745475 | 10/1977 | Fed. Rep. of Germany . | |
| 2701921 | 7/1978 | Fed. Rep. of Germany . | |
| 53-22418 | 8/1978 | Japan . | |
| 55-46617 | 4/1980 | Japan | 343/712 |

OTHER PUBLICATIONS

Report from Naval Research entitled "Novel Low Frequency Loop Antenna" by Jones and Serota, vol. 3, No. 5 (1978.05).

Japanese Pat. Abstract., vol. 6, No. 37 E-97, Mar. 6, 1982, 56-156031.

Japanese Pat. Abstract, vol. 7, No. 162 E-187, 7/15/83, 58-70640, 58-70642.

Japanese Pat. Abstract, vol. 6, No. 55 E-101, 4/10/82, 56-168441.

*Primary Examiner*—William L. Sikes

*Assistant Examiner*—Robert E. Wise

*Attorney, Agent, or Firm*—Cushman, Darby & Cushman

[57] ABSTRACT

An automobile antenna system mounted on a vehicle body electromagnetically detects surface currents induced on the vehicle body by broadcast waves. The antenna system includes a casing, a loop antenna and circuitry housed in the casing. A part of the loop antenna which is exposed from an opening provided in the casing is mounted on the vehicle body in proximity to a marginal edge portion thereof. The casing has a metallic electrostatically shielded portion for housing the circuitry.

7 Claims, 10 Drawing Sheets

AUTOMOBILE ANTENNA SYSTEM

BACKGROUND OF THE INVENTION

1. Field of the Invention

The present invention relates to an automobile antenna system and, more particularly, to an improved automobile antenna system for effectively detecting broadcast radio waves received by the vehicle body and then transferring detected signals to various receivers located in the vehicle.

2. Description of the Prior Art

Antenna systems are indispensable to modern automobiles which must positively receive various broadcast waves such as those for radio, television and telephone at the receivers located within the vehicle. Such antenna systems are also very important for citizen band transceivers.

One of the conventional antenna systems is known as a pole-type antenna which projects outwardly from the vehicle body of an automobile. Although such a pole antenna is superior in performance in its own way, it always remains a nuisance from the viewpoint of vehicle body design.

Furthermore, the pole antenna is disadvantageous in that it is subject to damage, tampering or theft and also in that the antenna acts to generate noises during high-speed driving. For these reasons, there has heretofore been a strong desire to eliminate the need for such pole antennas.

With the enlargement of the frequency bands for broadcast or communication waves received at automobiles in recent years, a plurality of pole antennas have been required in accordance with each frequency band. This brings about other problems; a plurality of pole antennas damages the aesthetic appearance of the automobile and the receiving performance is greatly deteriorated by electrical interference between the antennas.

Efforts have been made to eliminate the pole antenna system or to conceal the antenna from the exterior. One such proposal has been to apply a length of antenna wire to the rearwindow glass of an automobile, and this proposal has been put into practical use.

Another proposal has been to detect surface currents which are induced by broadcast waves on the vehicle body of an automobile. This seems to be the most positive and efficient way for receiving broadcast waves, but the experiments carried out to date have not provided any satisfactory results.

One of the reasons why surface currents induced on the vehicle body by broadcast waves have not been utilized well is that their induced value is not as large as expected. Although the prior art mainly uses surface currents induced on the roof panel of the vehicle body, no surface currents of a satisfactory level have been obtained.

Another reason is that surface currents contain noises of a very high level. Such noises are mainly generated by the engine ignition system and the battery charging regulator and cannot be eliminated unless the engine is stopped. Noises transmitted to the interior of the vehicle make it impossible to effect any practicably clear reception of broadcast waves.

In such a situation, some proposals have been made to overcome the above problems. One of such proposal is disclosed in Japanese Patent Publication No. 22418/1978 in which an electrical insulation is formed at a portion of the vehicle body on which currents are concentrated, with the currents being detected directly by a sensor between the opposite ends of the insulation. Although such structure can detect usable signals which are superior in S/N ratio, a pickup used therein requires a particular cutout in the vehicle body. This cannot be accepted in the mass-production of automobiles.

Another proposal is disclosed in Japanese Utility Model Publication No. 34826/1978 in which an antenna including a pickup coil for detecting currents in the pillar of a vehicle body is provided. This is advantageous in that the antenna can be disposed completely within the vehicle body. However, it is not practical for the pickup coil used therein to be located adjacent to the vehicle pillar in a direction perpendicular to the longitudinal axis of the pillar. Thus, it also appears that this arrangement cannot pick up any usable output from the antenna.

As has been described above, the conventional antenna systems have not been successful in efficiently detecting currents induced on the vehicle body by broadcast waves.

No effective measure has heretofore been proposed for overcoming the above-described principal problems of the conventional art in providing, in particular, a pickup structure for effectively detecting currents induced on the vehicle body by broadcast waves and a pickup arrangement capable of obtaining a usable S/N ratio. The results of various kinds of experiments show that it might in fact be basically impracticable to use an antenna system which utilizes currents flowing on the vehicle body.

SUMMARY OF THE INVENTION

In view of the above-described problems of the prior art, it is an object of the present invention to provide a small-sized improved antenna system for automobiles which is capable of effectively detecting currents induced on the vehicle body by broadcast waves and then transferring detected signals to various receivers located in the vehicle and which is also capable of improving sensitivity and freedom from noise interference.

To achieve this aim, the present invention provides an antenna system having a high-frequency pickup disposed adjacent to a marginal edge portion of the vehicle body for detecting high-frequency surface currents having a frequency of a predetermined value or greater. The high-frequency pickup has a loop antenna and circuitry connected to the loop antenna to process the detected signals. The loop antenna facing a marginal edge portion of the vehicle body, is housed in a casing, the casing having an opening provided in the longitudinal direction of the loop antenna, and the circuitry being housed in the electrostatically shielded portion of the casing. Brackets are provided for fastening the high-frequency pickup to the vehicle body.

The prior art antenna systems mainly to receive AM band waves of a wavelength which is too long to obtain good performance by detection of the surface currents induced on the vehicle body. The inventors paid attention to this question of frequency and made it possible to very efficiently receive signals from surface currents induced on the vehicle body by broadcast waves which are above the FM frequency band (normally, above 50 MHz).

The inventors also took notice of the fact that such high-frequency surface currents are produced at various different locations of the vehicle body in various different densities. Our invention is therefore characterized by the fact that the high-frequency pickup is disposed at the location on the vehicle body that experiences the minimum level of noise and the maximum density of currents induced by broadcast waves. In one preferred form of the present invention, a location capable of satisfying such a condition is particularly found at or near the marginal edge of the vehicle body.

Furthermore, the present invention is characterized in that the high-frequency pickup is disposed along the marginal edge of the vehicle body within a range represented by $12\times10^{-3}$ c/f(m), wherein c=the velocity of light and f=the carrier frequency of the broadcast wave, so as to be able to positively detect the high-frequency currents. The pickup adopted for effecting the detection with increased efficiency may be in the form of a loop antenna for electromagnetically detecting magnetic flux induced by surface currents on the vehicle body, of electrode means capable of forming an electrostatic capacity between the pickup and a trunk hinge of the vehicle body so as to electrostatically detect high-frequency signals, or of coil means including a sliding core.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiments of the automobile antenna system according to the present invention will be described hereinunder with reference to the accompanying drawings.

FIGS. 1 to 9 illustrate a process of examining the distribution characteristics of high-frequency currents to know a location at which an antenna system can operate most efficiently on the vehicle body of an automobile.

Figure 1:
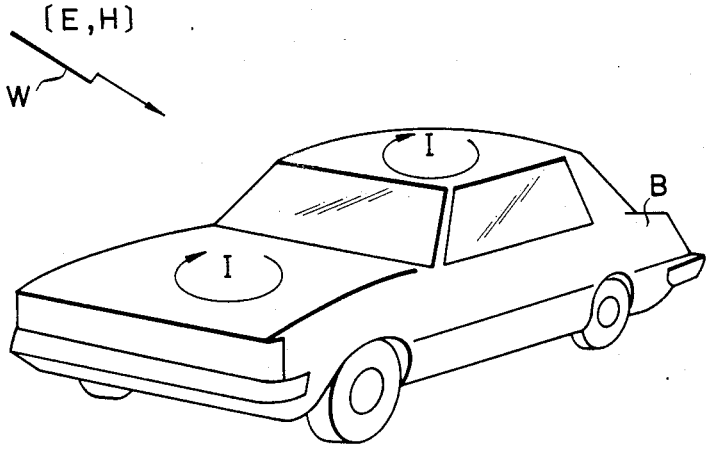
FIG. 1 illustrates surface currents I induced on the vehicle body B by external waves W.

FIG. 1 shows that when external electromagnetic waves W, such as broadcast waves, pass through the vehicle body B of conductive metal, surface currents I are induced at various vehicle locations at levels corresponding to the intensities of electromagnetic waves passing therethrough. The present invention aims at only electromagnetic waves which belong to relatively high frequency bands in excess of 50 MHz, such as FM broadcast waves, television waves and others.

The present invention is characterized in that the distribution of the surface currents induced on the vehicle body by electromagnetic waves within the above-described particular wave bands is measured so as to seek a location on the vehicle body which is higher in surface current density and lower in noise and at which a pickup used in the present invention is to be located.

The distribution of surface currents is determined by a simulation using a computer and also by measuring actual intensities of surface currents at various locations on a vehicle. In accordance with the present invention, the measurement is carried out by the use of a probe which can operate in accordance with the same principle as that of a high-frequency pickup actually located on the vehicle body at the desired location, as will be described later. Such a probe is moved on the vehicle body throughout the entire surface thereof to measure the level of surface currents at various locations of the vehicle body.

Figure 2:
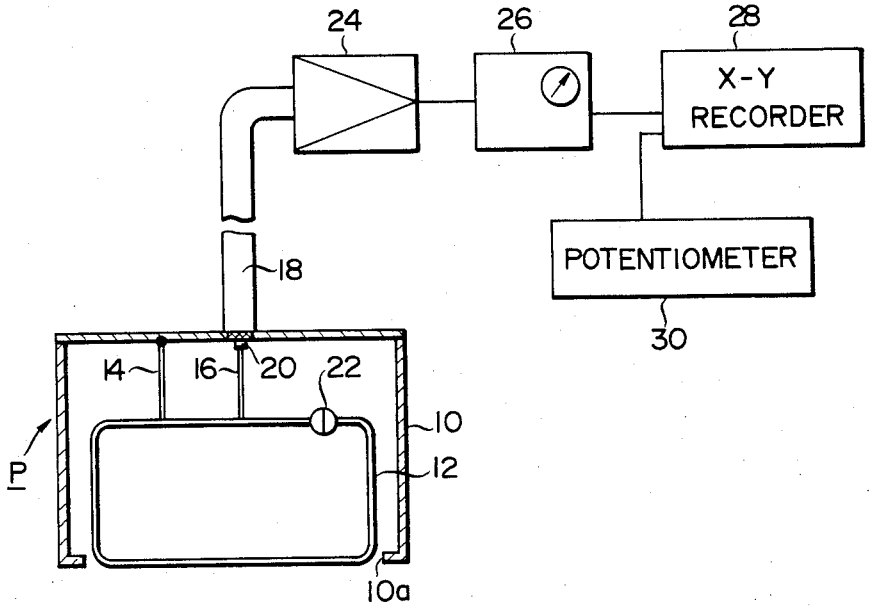
FIG. 2 illustrates a probe for detecting the distribution of surface currents on the vehicle body and having the same construction as that of the high-frequency pickup used in the present invention, and a circuit for processing signals from the probe.

FIG. 2 shows an example of such a probe P which is constructed in accordance with substantially the same principle as that of the high-frequency pickup described hereinafter. The probe P is composed of a casing of electrically conductive material 10 for preventing any external electromagnetic wave from transmitting to the interior thereof and a loop coil 12 rigidly located within the casing 10. The casing 10 includes an opening 10*a* formed therein through which a portion of the loop coil 12 is externally exposed. The exposed portion of the loop coil 12 is positioned in close proximity to the surface of the vehicle body B to detect magnetic flux induced by surface currents on the vehicle body B. Another portion of the loop coil 12 is connected with the casing 10 through a short-circuiting line 14. The loop coil 12 further includes an output end 16 connected with a core 20 in coaxial cable 18. Still another portion of the loop coil 12 includes a capacitor 22 for causing the frequency in the loop coil 12 to resonate relative to the desired frequency to be measured to increase the efficiency of the pickup.

Thus, when the probe P is moved along the surface of the vehicle body B and is also angularly rotated at various locations of measurement, the distribution and direction of surface currents can accurately be determined at each of the vehicle locations. In FIG. 2, the output of the probe P is amplified by a high-frequency voltage amplifier 24 and the resulting output voltage is measured by a high-frequency voltmeter 26. This coil output voltage is read at the indicated value of the high-frequency voltmeter 26 and also is recorded by an XY recorder 28 to provide the distribution of surface currents at various vehicle locations. The input of the XY recorder 28 receives signals indicative of various vehicle locations from a potentiometer 30 to recognize the value of high-frequency surface currents at the corresponding vehicle location.

Figure 3:
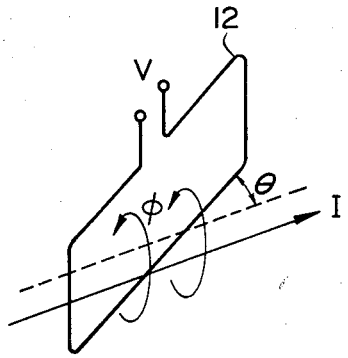
FIG. 3 illustrates the electromagnetic coupling between the surface currents I and the pickup loop antenna.
Figure 4:
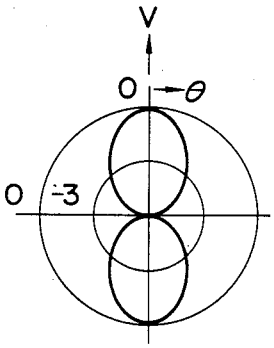
FIG. 4 illustrates the directional pattern of the loop antenna shown in FIG. 3.

FIG. 3 illustrates an angle $\theta$ of deflection between the high-frequency surface currents I and the loop coil 12 of the pickup. As is clear from the drawing, magnetic flux $\phi$ intersects the loop coil 12 to generate a detection voltage V in the loop coil 12. As shown in FIG. 4, when the angle $\theta$ of deflection is equal to zero, that is, the surface currents I are parallel to the loop coil 12 of the pickup, the maximum voltage can be obtained. The direction of the surface currents I when the probe P is rotated to obtain the maximum voltage can also be known.

Figure 5:
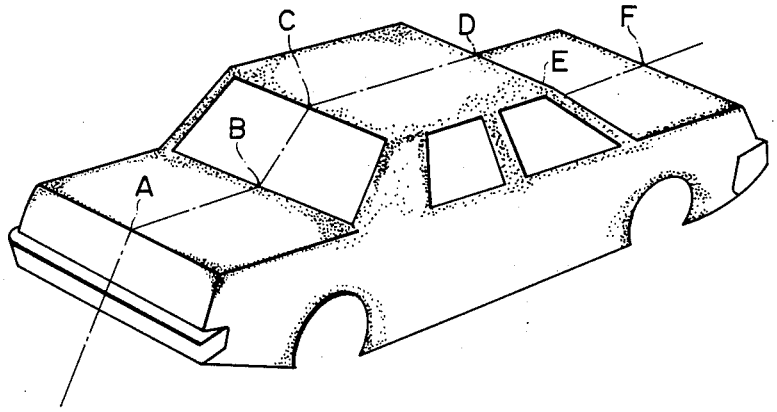
FIG. 5 illustrates the intensity distribution of the surface currents.
Figure 6:
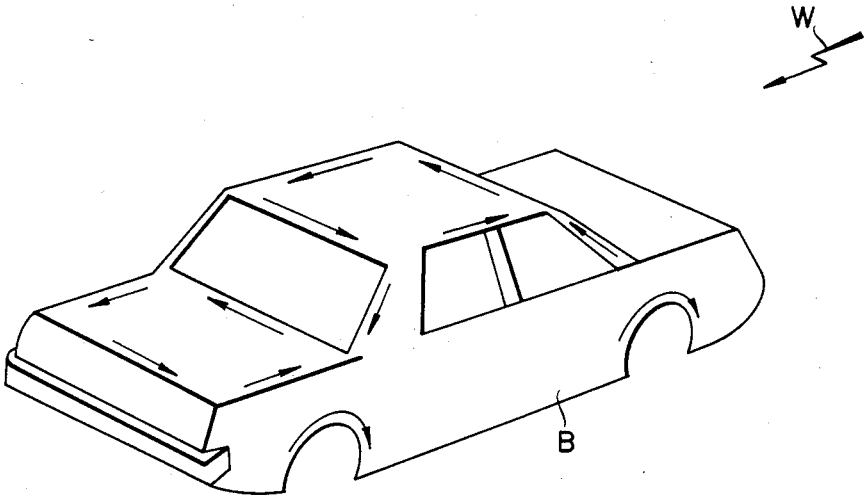
FIG. 6 illustrates the directions of flow of the surface currents.

FIGS. 5 and 6 respectively show the magnitude and direction of high-frequency surface currents induced at various different locations of the vehicle body at the frequency of 80 MHz, the values of which are obtained from the measurements of the probe P and the simulation effected by the computer. As can be seen from FIG. 6, the distribution of surface currents has higher densities at the marginal edge of the vehicle body and lower densities at the central portions of the flat vehicle panels.

It will also be apparent from FIG. 6 that the surface currents are concentrated in the direction parallel to the marginal edge of the vehicle body or in the direction along the connections of various flat panels.

Figure 8:
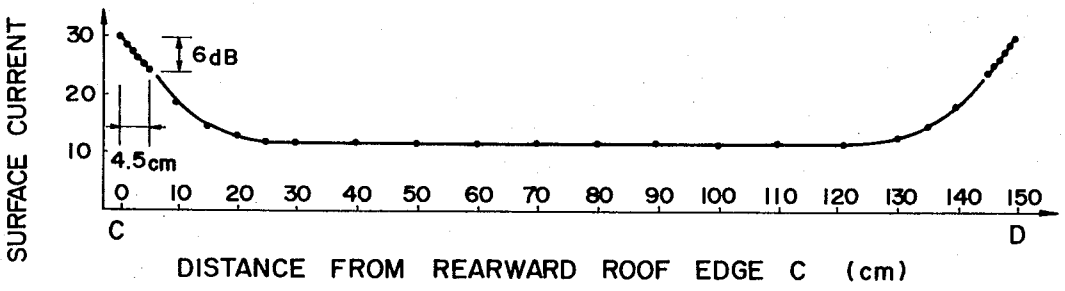
FIGS. 7, 8 and 9 are graphs showing the distribution of surface currents at various locations of the vehicle body shown in FIG. 5 along the longitudinal axis.
Figure 9:
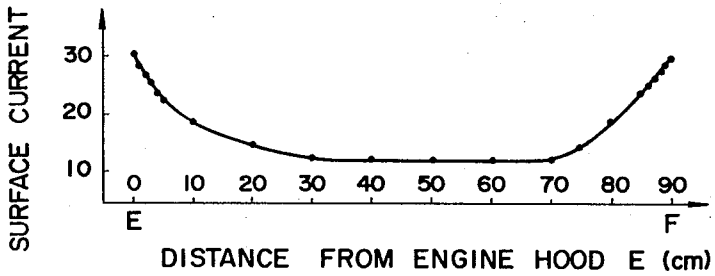
Figure 7:
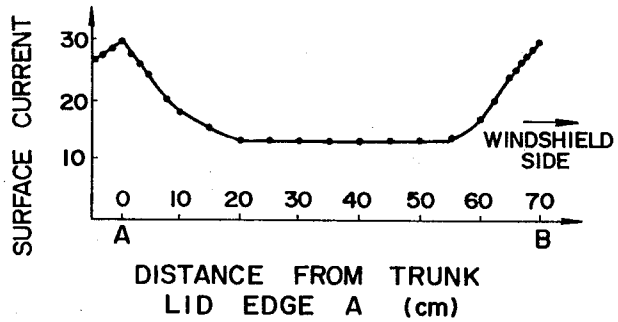

Carefully studying the distribution of surface currents induced at various metallic vehicle portions along the longitudinal axis of the vehicle body as shown in FIG. 6, distribution characteristics such as those shown in FIGS. 7 to 9 can be obtained.

FIG. 7 shows a distribution of surface currents along a trunk lid between two points A and B on the longitudinal axis (see FIG. 5). As can be seen from FIG. 7, the surface currents attain very high levels at these points A and B and decrease toward the central portion of the trunk lid from the opposite points thereof.

Thus, if a high-frequency pickup is disposed near the marginal edge of the trunk lid, the currents concentrating thereon can be detected.

Similarly, FIG. 8 shows the distribution of surface currents along the roof panel of the vehicle body while FIG. 9 shows the distribution of surface currents along the engine hood of the vehicle body. As is apparent from these drawings, surface currents of a very high level flow at the marginal edges of the roof panel and the engine hood, respectively. The value of the surface currents decreases toward the central portion of each panel area of the vehicle body.

It is thus understood that the pickup should be disposed at or near the marginal edge of each of the vehicle panel areas in order to catch broadcast waves with high sensitivity.

It goes without saying that the high-frequency pickup can similarly be located on one of the pillars and fenders as well as on the trunk lid, the engine hood and the roof panel in the present invention.

Although the loop antenna of the high-frequency pickup is arranged longitudinally adjacent to and along the marginal edge of each vehicle panel area in accordance with the present invention, this loop antenna is preferably positioned within a range determined depending upon the carrier frequency of broadcast waves in order to obtain sensitivity-very suitable for practical use.

The distribution of currents shown in FIGS. 7 to 9 relate to the currents induced on the vehicle body by FM broadcast waves having a frequency of 80 MHz. The value of surface currents decreases in accordance with the distance between the position of the surface currents and the marginal portions of the vehicle. Considering that good sensitivity can actually be obtained in the range of decreased currents below 6 dB, it is understood that such sensitivity may be realized if the pickup is located within a distance of 4.5 cm from each marginal edge of the vehicle.

Thus, a satisfactory antenna system can be provided in accordance with the present invention if a high-frequency pickup is arranged within a distance of 4.5 cm away from a marginal vehicle portion for the carrier frequency of 80 MHz.

It is found from the computer's simulation and experimental measurements that the above distance which is suitable for practical use depends upon the carrier frequency used therein. It is also recognized that the distance is decreased as the value of the carrier frequency is increased.

From the fact that the suitable distance of 4.5 cm from the corresponding marginal vehicle portion is inversely proportional to the value of the carrier frequency, good results can be obtained relative to the respective values of the carrier frequency if the high-frequency pickup is spaced away from the marginal edge of a metallic vehicle panel within a distance represented by the following formula:

$$12\times10^{-3}\ c/f(m)$$

where c = the velocity of light and f = carrier frequency.

In this manner, the present invention provides an improved high-frequency pickup which is located adjacent to the marginal edge of each panel area of the metallic vehicle body and which is preferably disposed within said range from that marginal edge.

For example, where a carrier frequency equal to 100 MHz is to be detected, a high-frequency pickup may be disposed at a vehicle location spaced away from a desired marginal edge of the vehicle body within a distance of 3.6 cm. It will be apparent that as the value of the carrier frequency f is increased, the distance between the high-frequency pickup and the corresponding marginal edge of the vehicle body will be decreased.

Figure 10:
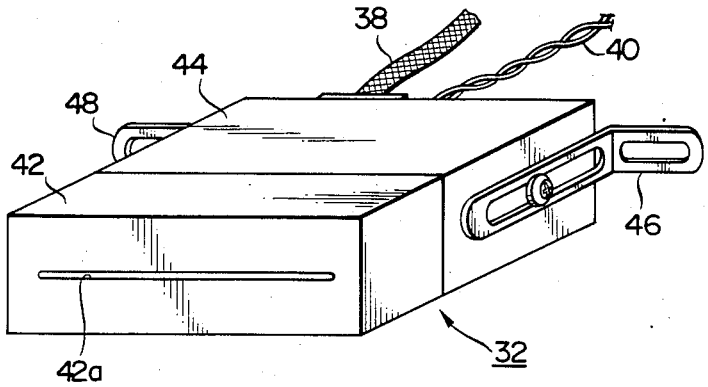
FIG. 10 is a perspective view of a high-frequency pickup in accordance with the present invention, the pickup including a first plastic casing for housing a loop antenna and a second metallic case housing the circuitry.
Figure 11:
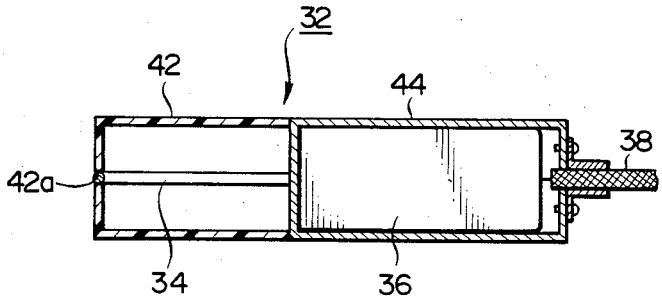
FIG. 11 is a fragmentary vertical sectional view of the pickup shown in FIG. 10.

FIG. 10 shows the external appearance of a high-frequency pickup suitable for a preferred embodiment of an automobile antenna system according to the present invention, and FIG. 11 is a schematic vertical sectional view thereof.

A high-frequency pickup 32 includes therewithin a loop antenna 34 for detecting high-frequency surface currents therewithin and circuitry 36 which is connected to the loop antenna in order to match and amplify the detection signal. The high frequency pickup 32 constituting an electromagnetic coupling type pickup in this way is disposed in proximity to a marginal edge of the vehicle body.

The high-frequency detection signal which is processed by the circuitry 36 is fetched outward from a coaxial cable 38, and is processed by a circuit similar to that used for measurement of the distribution of the surface currents. A power source and a signal for controlling the circuit is supplied to the circuitry 36 from a cable 40.

The high-frequency pickup 32 is composed of a first casing 42 and a second casing 44, which protect the loop antenna 34, and the circuitry 36, and is provided with brackets 46, 48 for fastening the high-frequency pickup 32 to the vehicle body.

The first casing 42 and the second casing 44 are secured to each other, and they are disposed such that the first casing 42 protects the loop antenna 34 and the second casing 44 protects the circuitry 36. The first casing 42 is formed of a synthetic resin, and an opening 42 is formed on the side facing the marginal edge portion of the vehicle body so that a longer side of the loop antenna 34 is exposed. Therefore, the magnetic flux induced by the high-frequency current flowing at the marginal edge portion of the vehicle body is positively caught by the loop antenna 34. In addition, since the first casing 42 is made of a synthetic resin, the loop surface is not magnetically shielded and thus the magnetic flux produced at the marginal edge portion of the vehicle body can be detected over a wide range. On the other hand, the second casing 44 is made of a metal and is connected to the shield layer of the coaxial cable 38, thereby functioning as an electrostatically shielded wall and removing the influence of any noise on the circuitry 36.

The brackets 46, 48 are made of a synthetic resin, and locate and firmly fix the high-frequency pickup 32 to the marginal edge portion of the vehicle body. When the high-frequency pickup 32 is mounted, it assumes an electrically insulated state, so that the output is increased by about 5 dB in comparison with a case where metal brackets are used. This is because they prevent the currents, in the opposite direction of the high-frequency surface currents flowing at the marginal edge portion of the vehicle body, from flowing into the metal casing 44 and decreasing the degree of magnetic flux which passes the loop surface.

The loop antenna 34 is in the form of a single wound coil which is covered with insulation such that the coil can be arranged in an electrically insulated relationship and in close contact with the marginal edge portion of the vehicle body. Thus the magnetic flux induced by the surface currents can intersect the loop antenna 42 with increased intensity.

In this embodiment, the side of the loop antenna 34 which is exposed from the casing 42 is disposed within a distance of 4.5 cm from the marginal edge portion of the vehicle body, whereby the FM broadcast waves of the frequency of 80 MHz can be positively detected from the surface currents flowing at the marginal edge portion of the vehicle body. Since the surface currents on the vehicle body flow along its marginal portions, as is clear from FIG. 6, the loop antenna 34 in this embodiment is disposed longitudinally along the marginal edge portion of the vehicle body.

As described above, in this embodiment, the surface currents flowing along the marginal edge of the vehicle body are electromagnetically detected with high sensitivity by the high-frequency pickup, and reception in a high-frequency range is ensured without any external exposure of the antenna system. In addition, the use of synthetic resin for various components reduces the weight of the antenna as a whole. Thus this embodiment is very useful as an automobile antenna system.

Figure 12:
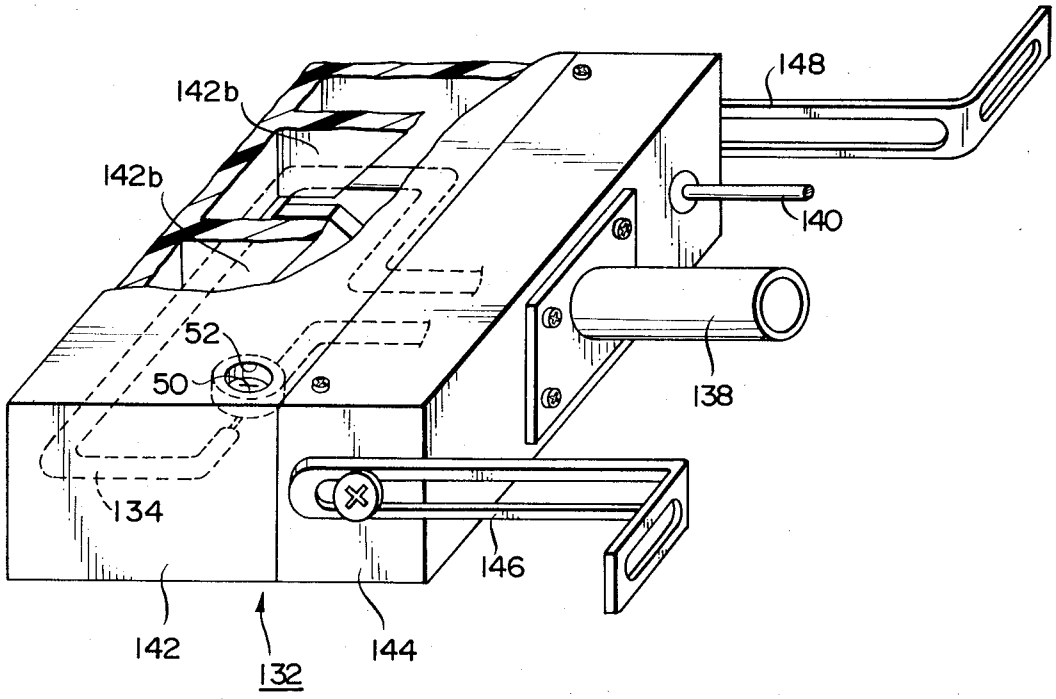
FIG. 12 is a partially cutaway perspective view of another embodiment of the present invention with the first casing provided with ribs for holding the loop antenna.
Figure 13:
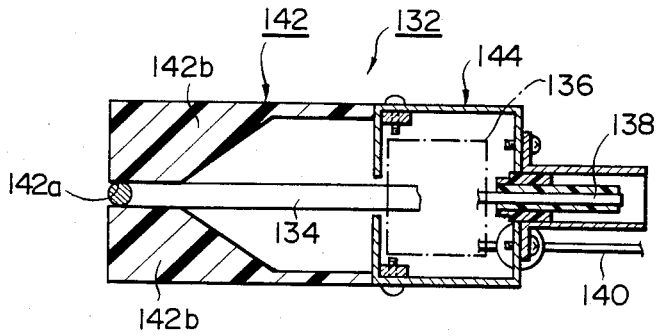
FIG. 13 is a fragmentary vertical sectional view of the embodiment shown in FIG. 12.

FIGS. 12 and 13 show another embodiment of the present invention. The same elements which appear in the above-described embodiment are indicated by the same reference numerals prefixed by the numeral 1.

Figure 14:
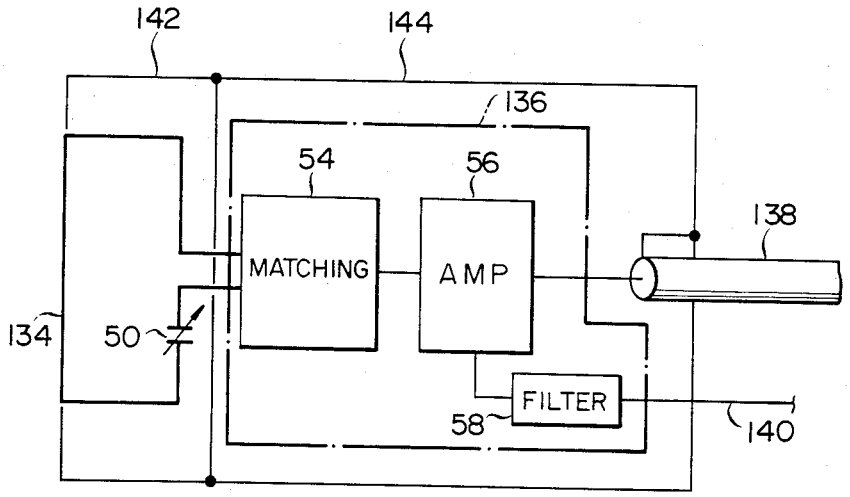
FIG. 14 is a circuit diagram of still another embodiment of the present invention in which a variable capacitor is connected to the loop antenna.

This embodiment is characterized in that a variable capacitor 50 is connected in series to a loop antenna 134 in a first casing 142. The frequency of the loop antenna 134 can be caused to resonate relative to a desired frequency to be measured in order to increase the efficiency of the pickup by adjusting the variable capacitor 50 through an adjust hole 52 formed in the first synthetic resin case 142. The structure of this circuitry is shown in FIG. 14. The detection signal fetched from the loop antenna 134 is connected to a matching circuit 54, the latter matching the impedance of the signal in relation to an amplifying circuit 56 which is to be employed in a later step. The amplifying circuit 56 is connected to a battery power source through a filter 58 by a cable 140 and the output of the amplifying circuit 56 is connected with a receiver by a coaxial cable 138.

This embodiment is also characterized in that one side of the antenna loop 134 is inserted into and retained by an opening **142*a* provided in a first synthetic resin casing 142, and in that reinforcing ribs 142*b* provided in the casing 142 clamp the loop antenna 134 therebetween. As a result, the loop antenna 134 provided with the capacitor 50** is held stably even in the face of vibration of the vehicle body, relative freedom from influence by vibration thus being improved.

Figure 15:
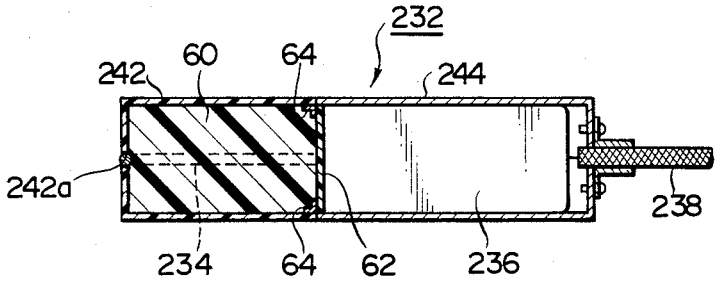
FIG. 15 is a fragmentary sectional view of a further embodiment of the present invention in which the loop antenna is held by a filling material in the first casing.

FIG. 15 shows another embodiment similar to that shown in FIG. 11. The loop antenna in this embodiment is fixed and held by a filling material in the first case. Elements similar to those shown in FIG. 11 are indicated by the correspondent reference numerals prefixed by the numeral 2.

This embodiment is characterized in that a loop antenna 234 is fixed and held by a filling material 60 in a first casing 242. As is indicated by the hatched portion in FIG. 15, a dielectric material having a low dielectric constant such as polyester, epoxy resin, silicone resin is formed by pouring, molding, or the like, in the gap between the casing 242 and the loop antenna 234 and integrally fixes and holds the loop antenna 234. The filling material 60 preferably has a dielectric constant of 2 to 4 in the frequency bands ranging from 70 to 1,000 MHz, and a small dielectric loss tangent tan In the embodiment, ribs 64 - 1, 64 - 2, . . . are provided around a printed circuit base board 62 which electrically connects the loop antenna 234 and circuitry 236, so that inclination or deformation of the printed circuit base board 62 is prevented.

According to this embodiment, the loop antenna 234 is firmly secured and held, and the loop antenna 234 does not resonate at all, furthermore the output does not attenuate even when pickup 232 is vibrated by the vibration of the vehicle body. This embodiment also prevents any probability of insufficient contact between the printed circuit base board 62 and the loop antenna 234. In addition, since the loop antenna 234 is enveloped by the filling material 60, no condensation is produced on the loop antenna 234 even in winter.

Figure 16:
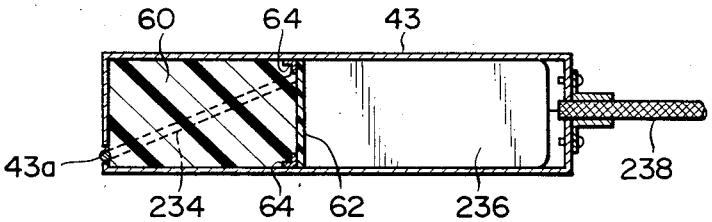
FIG. 16 is a fragmentary sectional view of a still further embodiment of the present invention in which the loop antenna is located obliquely and held by a filling material in a metal casing.

FIG. 16 shows still another embodiment, in which the loop antenna 234 is provided in such a manner as to be inclined in relation to the printed circuit base board 62. Such arrangement allows the loop antenna 234 to have a large loop surface and, hence, the output is advantageously increased.

In the embodiment shown in FIG. 16, the loop antenna 234 and circuitry 236 are housed in a metal casing 43.

Figure 17:
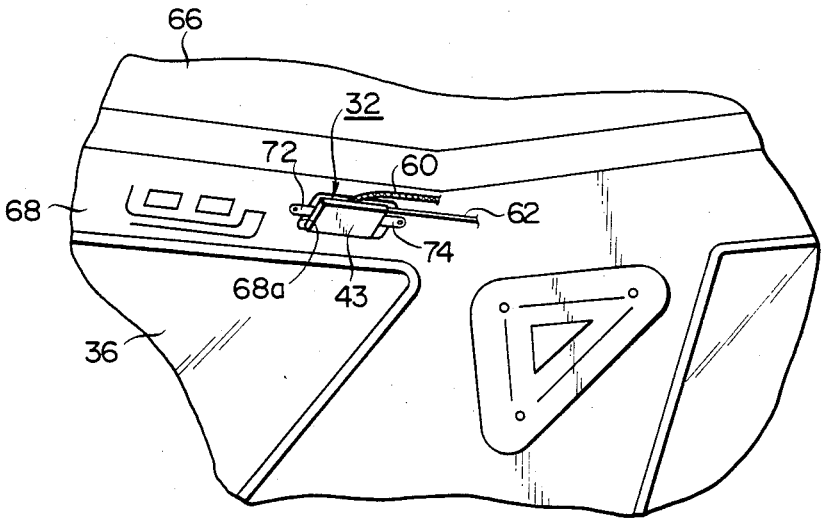
FIG. 17 is a perspective view of a high-frequency pickup mounted on the roof panel of a vehicle body.

FIG. 17 shows the high-frequency pickup in accordance with the invention, mounted on the rear marginal edge portion of the roof panel.

In the drawing, a roof panel 66 is illustrated in the exposed state, and the metallic roof panel 66 is connected to a rearwindow glass 70 with a rearwindow frame 68 as its marginal edge. In this embodiment, the high-frequency pickup 32 is disposed within a distance of 4.5 cm inward of the rearwindow frame 70.

In this case, an opening **68*a* is provided at a part of the rearwindow frame 68 in order to dispose the loop antenna of the high-frequency pickup 32 such as to face the marginal edge portion of the rearwindow frame 68, and the casing 43 of the high-frequency pickup 32 is inserted into the opening 68*a***.

In order to locate and fix the case 43 of the high-frequency pickup 32 in relation to the rearwindow frame 68, L-shaped brackets 72 and 74 are connected to both side surfaces of the casing 43 by bolts or the like. These brackets 54 and 56 are screwed to the rearwindow frame 68.

The loop antenna is in the form of a compound wound coil which is covered with insulation such that the coil can be arranged in an electrically insulated relationship with and in close contact with the rear window frame 68. Thus, the magnetic flux induced by the surface currents can intersect the loop antenna with increased intensity.

In this embodiment, the loop antenna is disposed within a distance of 4.5 cm from the edge portion of the rearwindow frame 68, whereby the FM broadcast waves of the frequency of 80 MHz can be positively detected from the surface currents flowing at the marginal edge portion of the rearwindow frame 68. Since the surface currents on the vehicle flow along its marginal portions, as is clear from FIG. 6, the loop antenna is disposed longitudinally along the marginal edge portion of the rearwindow frame 68.

As described above, in this embodiment, the surface currents flowing along the marginal edge of the vehicle, especially along the marginal edge portion of the roof panel, are electromagnetically detected with high sensitivity by the high-frequency pickup, and reception in a high-frequency range is ensured without any external exposure of the antenna system. Thus this embodiment provides a very useful automobile antenna system.

Figure 18:
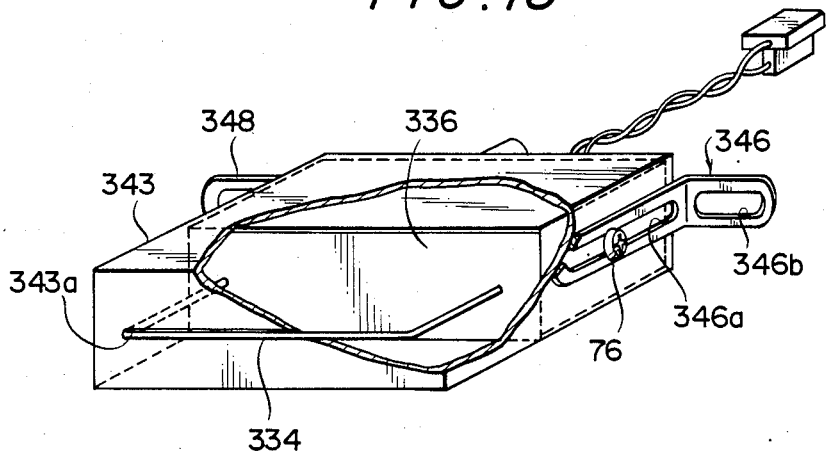
FIG. 18 is a partially cutaway view of a still further embodiment of the present invention in which a high-frequency pickup is secured to the vehicle body by brackets at a desired angle.

FIG. 18 shows a further embodiment of the present invention. This embodiment is characterized in that brackets for securing the electrostatically shielded casing to the vehicle body are screwed to the electrostatically shielded casing, and screw receiving holes for receiving screws serve also as slots for adjusting the position of the screw.

In this embodiment, the bracket can be fixed at a desired position in the slot for adjusting the retaining position of the screw provided on the bracket, and therefore the positional relationship between the metallic vehicle panel and the automobile antenna system can also be adjusted as desired, by varying the retaining position of the screws on the brackets in relation to the electrostatically shielded casing. Accordingly, the automobile antenna system in this embodiment can be attached to various kinds of automobiles, various portions, or under various conditions of mounting, at an optimum position and angle for efficiently detecting the surface currents on the metallic vehicle panel, and thus enable good reception of broadcast waves.

In the automobile antenna system shown in FIG. 18, a loop antenna 334 is fixed within an electrostatically shielded casing 343.

An opening **343*a* is provided through which the longer side of the loop antenna 334 is exposed, and the part of the loop antenna 334 exposed from the casing 343** of a conductive material is opposed to a metallic vehicle panel such as a roof remover in proximity thereto.

This embodiment is characterized in that brackets for attaching the antenna system to the vehicle body are provided on the electrostatically shielded casing. The brackets are capable of adjusting the positional relationships between the automobile antenna system and the metallic vehicle panel. To this end, brackets 346, 348 having an L-shaped cross section are secured to both side surfaces of the electrostatically shielded casing 343.

The bracket 346 is provided on the surface to which the casing is secured with a slot **346*a* for adjusting the position of the screw, and the bracket 346 and the electrostatically shielded casing 343 are fixed by means of a screw 76 through the slot 346*a***.

A receiving hole **346*b* which receives a screw for attaching the antenna system to the vehicle body is also provided on that portion of the bracket 346** which is attached to the vehicle body.

In this way, according to the automobile antenna system in the embodiment, the relative position of the bracket 346 and the electrostatically shielded casing 343 is capable of adjustment as desired by varying the retaining position of the screw 76 in the slot **346*a*. Needless to say, the relative angle of the bracket 346 and the electrostatically shielded casing 343 is also capable of being adjusted as desired by varying the angle between the casing 343 and the bracket 346**.

Since the screw receiving hole **346*b*** in this embodiment is in the form of a slot, adjustment of position of the screw in the bracket in relation to the vehicle body is also facilitated.

Figure 19:
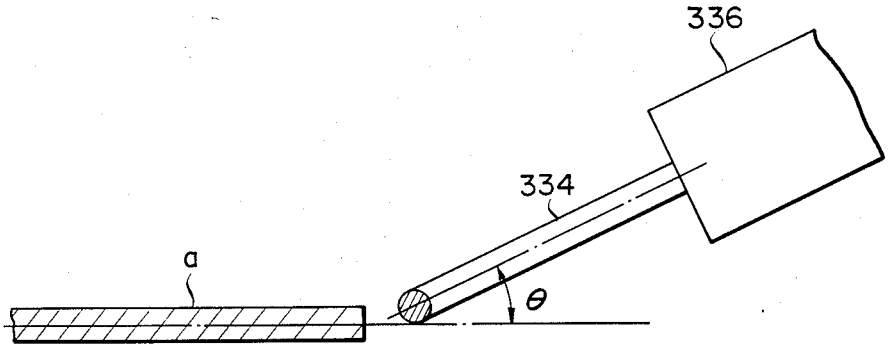
FIG. 19 is an explanatory view of an experiment undertaken for the purpose of examining a relative angle between the metallic vehicle panel and the loop surface of the loop antenna, and how it affects the efficiency of detecting the surface currents on the vehicle body.

FIG. 19 shows a state in which the loop antenna 334 is located in proximity to a metallic vehicle panel a.

The angle of degrees between the loop surface of the loop antenna 334 and the prolongation of the center line of the metallic vehicle panel a was varied successively in this state, to examine how it affects the efficiency of detecting the surface currents flowing on the metallic panel a.

Figure 20:
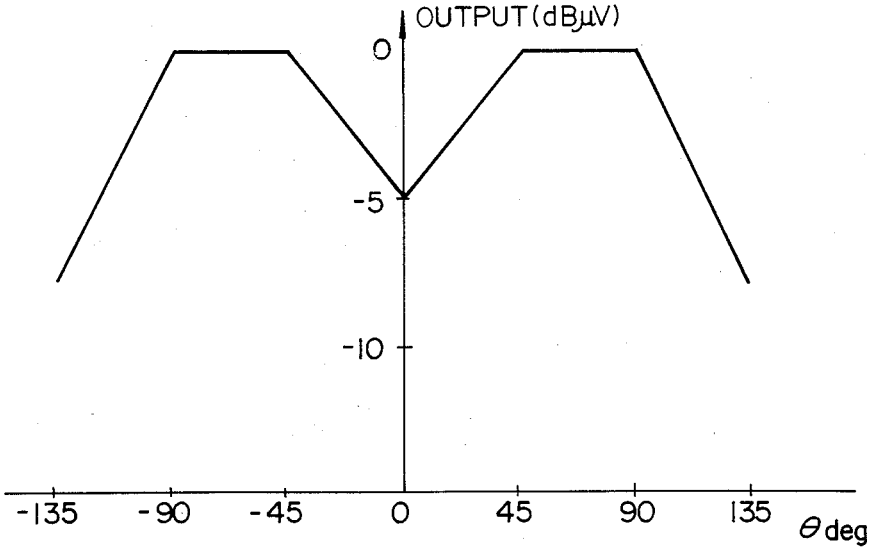
FIG. 20 is an explanatory diagram of the results of the measurements taken in the experiment shown in FIG. 19.

The results of the measurements are shown in FIG. 20. It will be understood from the graph that the efficiency in detecting the surface currents is very good when the angle $\theta$ between the loop surface of the loop antenna 334 and the prolongation of the center line of the metallic panel a is within the range of 45 to 90 degrees or −45 to −90 degrees, and that the efficiency is lowered if any other angle is employed.

In other words, with reference to FIG. 19, the surface currents are detected with high efficiency if the loop antenna 334 of the automobile antenna system is arranged such that the loop surface thereof makes an angle of 45 to 90 degrees or −45 to −90 degrees with respect to the prolongation of the center line of the metallic panel a.

It is known that the efficiency of the loop antenna in picking up the magnetic flux induced by the surface currents on the vehicle body is decreased directly in proportion to the square of the distance between the metallic panel and the loop antenna. Therefore it is preferable that the loop antenna 334 is arranged in close proximity to the metallic vehicle panel.

As described above, it will be understood that the position of the loop antenna and further, the state in which the automobile antenna system is mounted lend great influence on the efficiency with which the surface currents induced on the metallic vehicle panel by broadcast waves are detected.

According to this embodiment, the brackets having the slots for adjusting the retaining position of the screws are secured to the electrostatically shielded casing through these slots, thereby enabling the positional relationship between the automobile antenna system and the metallic vehicle panel to be adjusted as desired, and, hence, the antenna system to be attached such as to efficiently detect the surface currents induced by broadcast waves and flowing through the metallic vehicle panel. Thus this embodiment dispenses with the need for an externally exposed pole antenna as employed in the prior art, or the like and provides a small-sized automobile antenna of high performance.

Furthermore, since the same antenna is usable for various kinds of automobiles and positions of mounting, mass production and, hence, reduction in costs are enabled.

Figure 21:
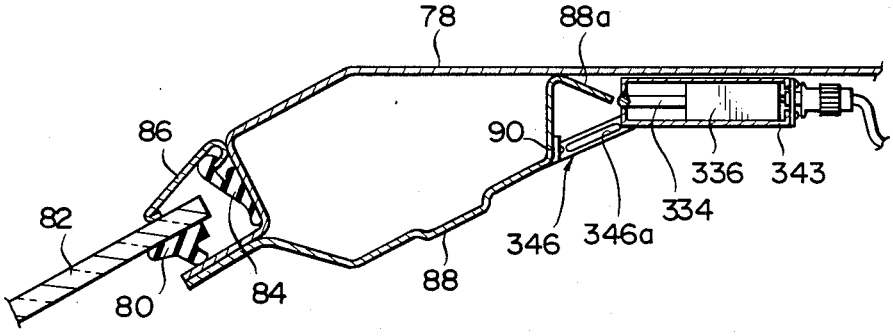
FIG. 21 is an explanatory view of an automobile antenna according to the present invention in the state wherein it is attached to the roof of the vehicle body.

FIG. 21 shows the automobile antenna system according to the invention in the state of being attached to the vehicle roof.

A rearwindow glass 82 is connected to the rear marginal edge of a roof panel 78 through a water sealing dam 80 and, the external marginal edge of the rearwindow glass 82 is, as is known, enveloped with a molding 86 with one end thereof secured to a stopper 84 which is provided on a roof panel 78.

The marginal edge portion of a roof remover 88 on the side of the rearwindow glass is opposed to the inside of the roof panel 78, and is bonded with the roof panel 78 by spot welding or the like. Therefore, the surface currents induced on the roof panel 78 by broadcasting waves flow not only on the roof panel but also on the roof remover 88 after being transmitted directly or diffracted.

The automobile antenna system shown in FIG. 21 is mounted in such a manner that the surface currents induced on the roof remover 88 by broadcast waves are detected with high efficiency.

The marginal edge portion **88*a* of the roof remover 88 is bent in such a manner that it makes an angle of 45 degrees in relation to the loop surface of the loop antenna 334, in other words, such that $\theta=45$ in FIG. 19, and the automobile antenna system is mounted such that the loop antenna 334 is opposed to the marginal edge portion 88*a*** of the roof remover in proximity thereto.

The automobile antenna system is supported by a bracket 346 which is attached to the side surface of an electrostatically shielded casing 343, and that portion of the bracket which is attached to the vehicle body is fastened to the marginal edge portion **88*a* of the roof remover 88 by a screw 90**.

That is, the automobile antenna system shown in FIG. 21 is in close contact with the roof panel 78, and it is possible to screw it to the roof panel 78, or to fix it by welding or the like. However, screwing it to the roof panel 78 requires a threaded hole to be formed therein greatly detracting from its appearance. Fixture of the antenna system by welding or the like makes it very difficult to minutely adjust the state in which the electrostatically shielded casing 343 and the marginal edge portion **88*a*** of the roof remover are disposed in proximity to each other.

In contrast, the automobile antenna system according to this embodiment brings about no such problem, and enables easy and accurate mounting and also enables the surface currents induced on the vehicle body by broadcast waves to be detected with high sensitivity.

In addition, since it is unnecessary to vary the shape of the electrostatic shield casing or the like irrespective of the kind of automobile or the position of mounting, unification of an automobile antenna system is enabled, resulting in achievement of mass production and reduction in costs.

Figure 22:
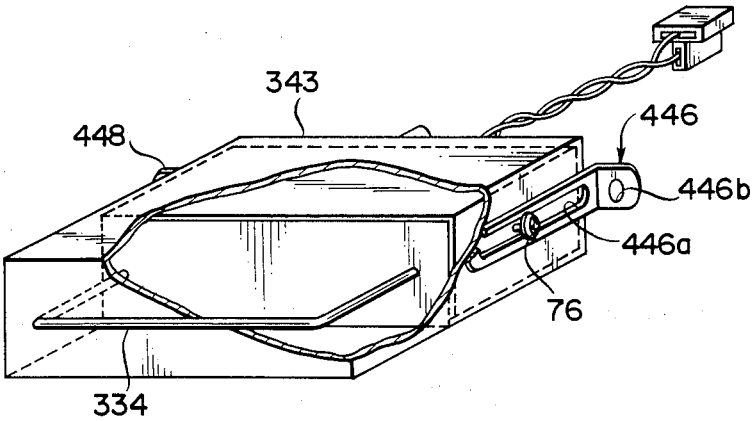
FIG. 22 is a perspective view of a still further embodiment similar to the embodiment shown in FIG. 18.

FIG. 22 shows a still further embodiment of an automobile antenna system according to the present invention. The same reference numerals are provided for the same elements as shown in FIG. 18, and their explanation will be omitted.

A screw receiving hole **446*b* with which the antenna system is attached to the vehicle body is in the form of a circle in this embodiment. Therefore the retaining position of the screw on the bracket 446** in relation to the vehicle body is unadjustable, but in practical use, this adjustment is not always essential.

As described above, an automobile antenna system according to this embodiment enables broadcast waves to be received positively and with high efficiency without any external exposure of the antenna system which electromagnetically detects the surface currents flowing on the metallic vehicle panel.

The automobile antenna system is mounted on the roof remover in this embodiment, but it may be mounted on another metallic vehicle panel such as the engine hood or the trunk lid.

The position to which the automobile antenna system is attached is preferably the marginal edge of the vehicle body or the marginal edge of the metallic lid or hood.

It will be apparent from the foregoing that the automobile antenna system in accordance with the present invention can receive broadcast waves of relatively high frequency bands such as FM frequency bands or more by detecting the surface currents induced on specific portions of the vehicle body, and, in particular, at the marginal edge portions of the vehicle body with a high-frequency pickup. Therefore, broadcast waves can be detected with high density and a low degree of noise interference.

A synthetic resin casing is used for protecting the loop antenna, while a metallic casing is used for protecting the circuitry, so that output with low noise interference can be received with high sensitivity. Since a synthetic resin is used for the bracket for mounting the antenna system to the vehicle body, larger output can be obtained than in the case where a metallic bracket is employed.

In addition, relative freedom from the influence of vibration can be further improved and the output voltage can be stabilized by fixing and holding the loop antenna of a current detection pickup by means of a filling material.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An automobile antenna system comprising:

a first casing mode of synthetic resin and having an elongated opening at one end;

loop antenna means fixed and secured within said first casing and having a portion arranged facing the opening of said first casing, said loop antenna means being provided for detecting surface currents induced on a vehicle body by broadcast waves;

a second casing made of metal and integrally connected to said first casing;

circuit means housed and electrostatically shielded within said second casing and connected to said loop antenna means for processing a signal detected by said loop antenna means;

said first casing, said second casing, said loop antenna means and said circuit means comprising a high-frequency pickup; and mounting means for mounting said high-frequency pick up at a given position in proximity to a marginal edge portion of the vehicle body where the induced surface currents are concentrated.

2. An automobile system according to claim 1, said mounting means including a bracket for fastening said high-frequency pickup to the vehicle body, said bracket being made of a synthetic resin.

3. An automobile antenna system according to claim 2, wherein said bracket which attaches said high-frequency pickup to the vehicle body is screwed to said second casing through a slot for adjusting the retaining position of the screw, so that the positional relationship between said high-frequency pickup and the vehicle body can be adjusted as desired by varying the position of the screw.

4. An automobile antenna system according to claim 1, a variable capacitor being connected to said loop antenna means.

5. An automobile antenna system according to claim 1, said loop antenna means being secured, in said first casing, by the opening provided in said first casing and by reinforcing ribs provided in said first casing.

6. An automobile antenna system according to claim 1, said loop antenna means being fixed and secured in said first casing by filling material.

7. An automobile antenna system according to claim 6, wherein said filling material is a dielectric material of a low dielectric constant.

* * * * *